US006226451B1

(12) United States Patent
Wong

(10) Patent No.: US 6,226,451 B1
(45) Date of Patent: May 1, 2001

(54) HUMIDIFIER

(75) Inventor: John Ying Man Wong, Shatin (HK)

(73) Assignee: Raymond Electric Ltd., New Territories (HK)

( * ) Notice: Subject to any disclaimer, the term of this patent is extended or adjusted under 35 U.S.C. 154(b) by 0 days.

(21) Appl. No.: 09/524,920

(22) Filed: Mar. 13, 2000

(51) Int. Cl.[7] ..... A61H 33/12; F02M 15/04
(52) U.S. Cl. ..... 392/405; 261/142
(58) Field of Search ..... 392/386, 390, 392/394, 399, 405, 406; 261/142, DIG. 65

(56) References Cited

U.S. PATENT DOCUMENTS 2,124,482 * 7/1938 Blair ..... 392/405
3,311,355 * 3/1967 Rait ..... 261/142
3,323,784 * 6/1967 Fazio ..... 261/130
4,089,915 * 5/1978 Jackson ..... 261/142
4,564,746 1/1986 Morton et al. .
5,014,338 5/1991 Glucksman .
6,115,539 * 9/2000 Cohn ..... 392/405

* cited by examiner

*Primary Examiner*—Sang Paik
(74) *Attorney, Agent, or Firm*—Leydig, Voit & Mayer, Ltd.

(57) ABSTRACT

A humidifier includes a reservoir for containing water and a steam generator incorporating an electrical heater for turning the water into steam. The generator includes an upwardly extending passage having a lower end for the entrance of steam produced by the heater into the passage and an upper end for exit of the steam. A freely rotatable fan is located in the passage for turning by the steam rising through the passage. An opening is located at the passage lower end, below the fan, for intake of relatively drier air from outside for mixing with rising steam to produce moderately moisturised air.

11 Claims, 3 Drawing Sheets

HUMIDIFIER

BACKGROUND OF THE INVENTION

Air humidifiers for domestic use are generally known and becoming popular. The steam produced, particularly when the humidifier is operating at full capacity, may sometimes be too concentrated and/or cause condensation on objects above it, which is undesirable.

The invention seeks to mitigate or at least alleviate such a problem by providing an improved humidifier.

SUMMARY OF THE INVENTION

According to the invention, there is provided a humidifier comprising a reservoir for containing water and a steam generator incorporating an electrical heater for turning the water into steam, the generator including an upwardly extending passage having a lower end for the entrance of steam produced by the heater into the passage and an upper end for subsequent exit of the steam, wherein a free rotatable fan is provided in the passage for turning by the steam rising through the passage and an opening is formed for the passage at a position below the fan for the intake of relatively drier air from outside into the passage for mixing with the rising steam to produce moderately moisturised air.

Preferably, the steam generator includes a heating chamber for containing water supplied from the reservoir and in which the heater is provided for turning the water contained in the chamber into steam.

More preferably, the passage is supported by the heating chamber to extend upwards, and the lower end of the passage is spaced apart from the heating chamber to form an annular gap therewith acting as said opening.

In a preferred embodiment, the heating chamber has an upper wall formed with a plurality of nozzles through which the steam produced in the chamber may rise into the passage, said nozzles having a converging cross-section for causing the steam passing through the nozzles to exit at an increased speed.

More preferably, the nozzles are arranged to point at a skewed direction for causing the steam to exit at an inclined angle, thereby directing the steam to swirl in the passage.

It is preferred that the heating chamber has an upper wall formed with a plurality of apertures through which the steam produced in the chamber may rise into the passage, said chamber including an internal sleeve dividing the interior into an inner chamber containing the apertures and the heater and an outer chamber surrounding the inner chamber, said outer chamber being arranged for initially receiving water supplied from the reservoir and in communication with the inner chamber at a lower position.

More preferably, the sleeve extends downwards from the upper wall around the apertures and reaching short of the bottom of the heating chamber.

In a preferred construction, the heating chamber has a bottom opening which is closed by an inwardly extending metal pocket for receiving the heater, thereby covering the heater while allowing it to heat the water contained in the chamber.

More preferably, the heater incorporates a heating element for receiving in the pocket, and the pocket has a shape matching with the general outer shape of the heating element for close contact therewith for efficient heat conduction.

More preferably, the heating chamber is separable from the heater and removable from the other parts of the humidifier for independent cleaning.

It is preferred that the passage is provided by a vertical cylinder opened at opposite ends.

BRIEF DESCRIPTION OF DRAWINGS

The invention will now be more particularly described, by way of example only, with reference to the accompanying drawings, in which.

DETAILED DESCRIPTION OF PREFERRED EMBODIMENT

Figure 1:
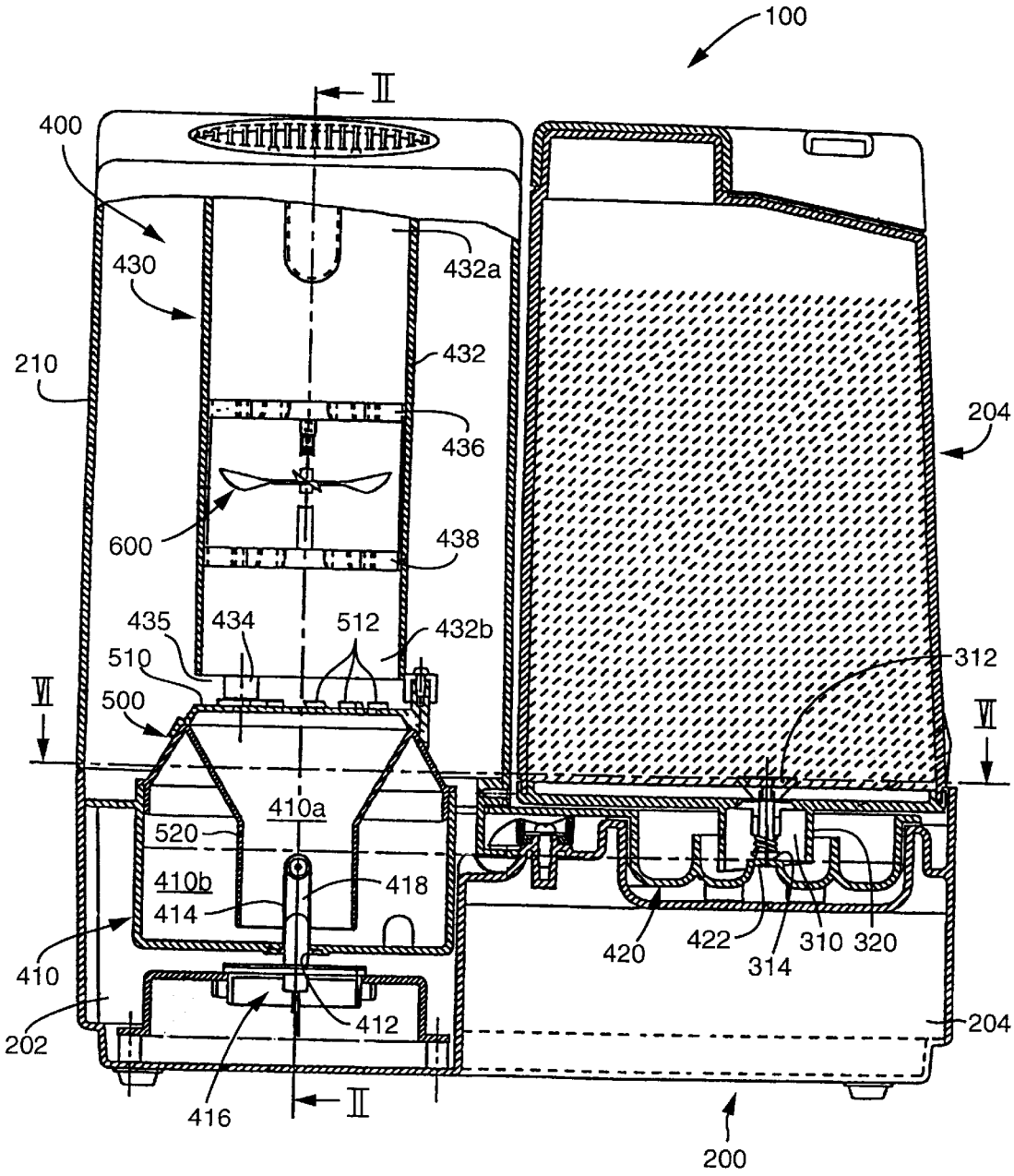
FIG. 1 is a cross-sectional front view of an embodiment of a humidifier in accordance with the invention.
Figure 3:
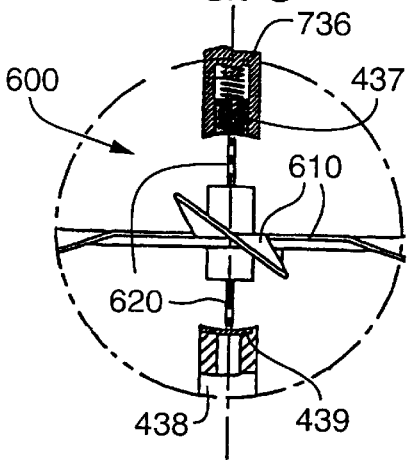
FIG. 3 is an enlarged view of a part of the humidifier of FIG. 2.
Figure 4:
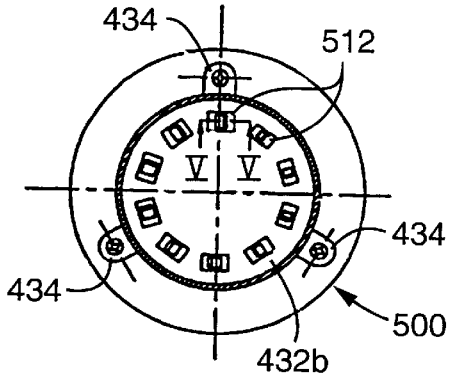
FIG. 4 is a cross-sectional top plan view of a part of the humidifier of FIG. 2, taken along line IV—IV.

Referring to the drawings, there is shown an air humidifier 100 embodying the invention, which humidifier 100 comprises a rectangular base 200 having left and right ends 202 and 204, a water tank 300 supported on the right base end 204, and a steam generator 400 located within a housing 210 on the left base end 202. The tank 300 has a bottom opening closable by a lid (not shown) and through which the tank 300 may be refilled with water, and includes a bottom exit controlled by a valve 310. The valve 310 incorporates a spring-loaded valve member 312 having a protruding stem 314 which is surrounded by an external depending collar 320 located at the bottom of the tank 300.

The steam generator 400 includes a cylindrical heating (boiling) chamber 410 located partially within the left base end 202, a spiral water path 420 extending horizontally from an outer side of the chamber 410 to the opposite base end 204, and a chimney 430 above and in vertical alignment with the chamber 410. The path 420 reaches immediately underneath the tank 300 and includes a central part 422 for abutment by the valve stem 314, when the tank 300 is placed atop, to open the valve 310. Water dispensed through the valve 310 is collected in the path 420 as well as guided by it into the chamber 410. The water supply will automatically stop when the water contained in the chamber 410 and path 420 rises to a level closing the free end of the collar 320.

The heating chamber 410 has a bottom opening in the form of a central slot 412 which is closed by a flat metal pocket 414 extending inwards from the rim of the slot 412. The pocket 414 is for receiving an electrical heater 416 to heat the water contained in the chamber 410. The heater 416 incorporates a heating bar 418 bent into a planar shape. The pocket 414 has a shape which matches with the general outer shape of the heating bar 418 for close contact therewith for efficient heat conduction. The use of the pocket 414, which covers and thus protects the heating bar 418 from mineral deposits allows the chamber 410 to be conveniently separated from the heater 416 and removed, together with the water path 420, from the other parts of the humidifier 100 for independent cleaning. As the pocket 414 has an outer shape which is less sophisticated than that of the heating bar 418, cleaning of the pocket 414 instead of the heating bar 418 is, relatively, easier.

The heating chamber 410 is closed by a frusto-conical lid 500, which in turn supports the chimney 430. The lid 500 has an upper wall 510 including a ring of nozzles 512 and includes an internal sleeve 520 depending from the upper wall 510 around all the nozzles 512. The lower end of the sleeve 520 has a rectangular cross-section for surrounding the pocket 414, reaching short of the bottom of the chamber 410. The sleeve 520 divides the interior of the heating chamber 410 into an inner chamber 410A containing the pocket 414 and an outer chamber 410B surrounding the inner chamber 410A, which are in communication with each other at their bottoms.

In operation, the heat of the heating bar 418 is conducted through the pocket 414 for turning the water in the inner chamber 410A into steam which rises up into the chimney 430 through the nozzles 512 of the chamber lid 510. Fresh water is replenished from the outer chamber 410B into the inner chamber 410A from below. The water in the outer chamber 410B is relatively cooler and serves as a water jacket to minimise heat loss. Also, the sleeve 520 reduces the water boiling volume.

Figure 5:
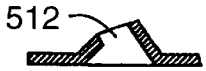
FIG. 5 is a cross-sectional side view of a part of the humidifier part of FIG. 4, taken along line V—V.
Figure 2:
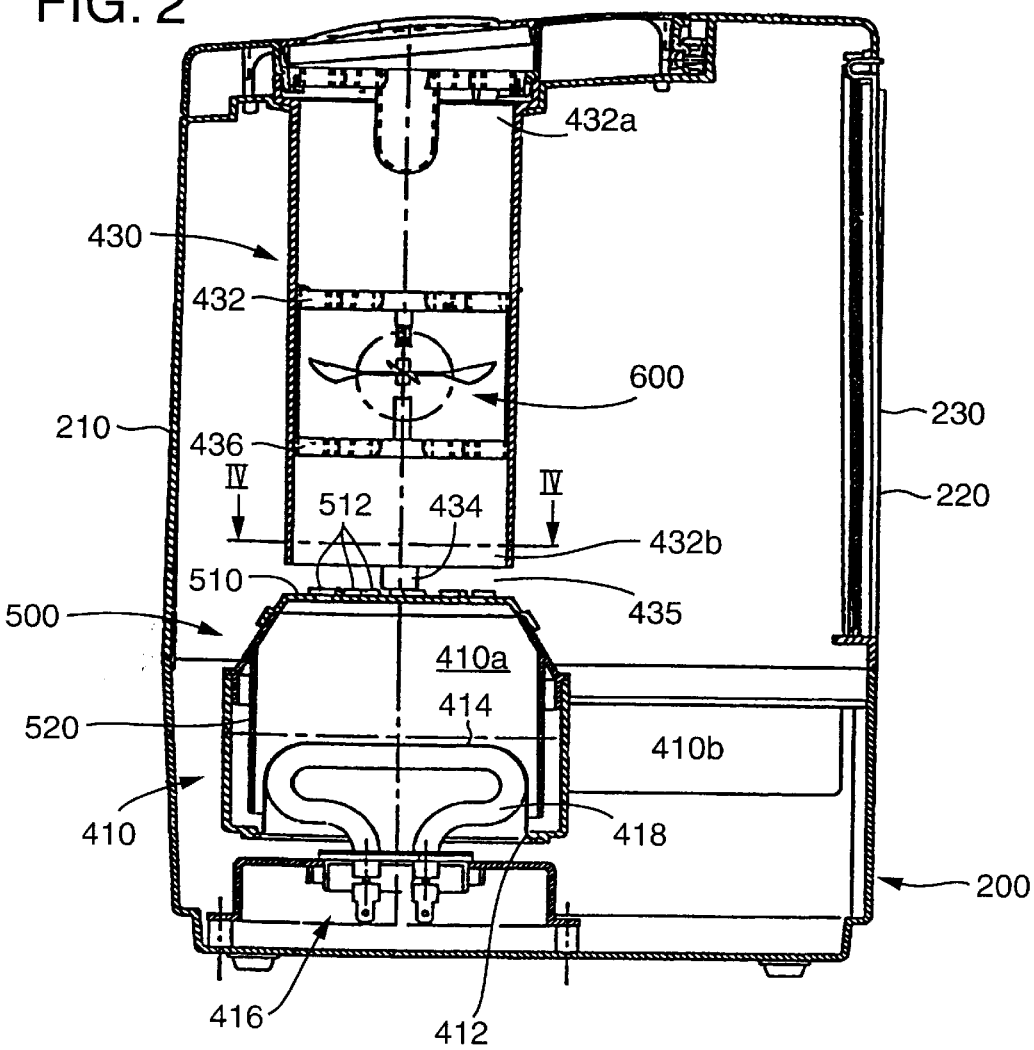
FIG. 2 is a cross-sectional side view of the humidifier of FIG. 1, taken along line I—I.
Figure 6:
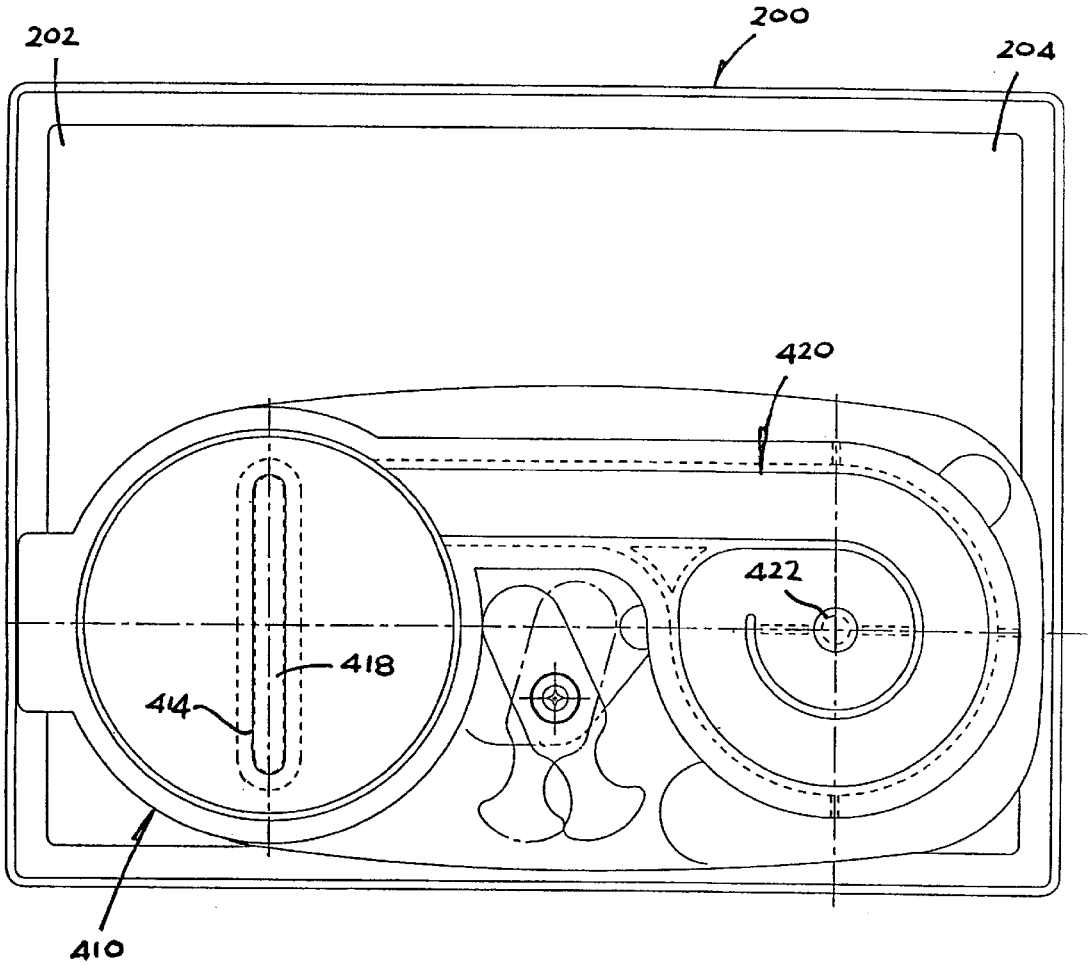
FIG. 6 is a cross-sectional top plan view of the humidifier of FIG. 1, taken along line VI—VI.

As shown in FIG. 5, the nozzles 512 of the chamber lid 510 have a converging cross-section and are arranged to point at a skewed direction. The converging cross-section causes the steam passing through the nozzles 512 to exit at an increased speed. The skewed direction causes the steam to exit at an inclined angle from the vertical direction, thereby directing the rising steam to swirl in the chimney 430.

The chimney 430 has a vertical cylindrical body 432 which has open top and bottom ends 432A and 432B, providing an upwardly extending passage for the steam, and is mounted co-axially on the chamber lid 510 by means of three legs 434. The bottom end 432B is spaced apart from the lid 510 to form an annular gap 435 therewith. The chimney body 432 includes a pair of upper and lower internal circular frames 436 and 438 holding co-axially between them a turbine fan 600. The fan 600 has a plurality of inclined blades 610 and a vertical shaft 610. The frames 436 and 438 are provided with respective central thrust bearings 437 and 439 supporting the shaft 610 at its opposite ends and, in turn, the overall fan 600 for free rotation.

In operation, the steam enters the chimney body 432 at its bottom end 432B. By reason of the converging cross-sections of the nozzles 512, the steam enters at an increased speed and this draws in air via the gap 435 through a venturi effect. The steam rising through the chimney body 432 turns the fan 600. The nozzles 512 are skewed in such a direction that the swirling motion of the steam promotes the rotation of the fan 600. While the fan 600 is set into rotation, it will create a suction effect at the chimney body bottom end 432B, thereby drawing air from outside into the chimney body 432 through the bottom gap 435. In this regard, the housing 210 is formed with a grilled inlet 220, which is covered by a filter 230, for the supply of air.

The intake air is relatively drier than the rising steam and is mixed thoroughly therewith by the rotating fan 600, together producing moderately moisturised air for exit from the chimney body top end 432A into the environment of a room, for example, in which the humidifier 100 is used.

The invention has been given by way of example only, and various modifications of and/or alterations to the described embodiment may be made by persons skilled in the art without departing from the scope of the invention as specified in the appended claims.

What is claimed is:

1. A humidifier comprising:

a reservoir for containing water; and a steam generator incorporating an electrical heater for turning water into steam and including an upwardly extending passage having a lower end for entrance of steam produced by the heater into the passage, an upper end for exit of the steam, a freely rotatable fan located in the passage for turning by the steam passing through the passage, and an opening for the passage located below the fan for intake of air into the passage for mixing with the steam passing through the passage to produce moderately moisturised air.

2. The humidifier as claimed in claim 1, wherein the steam generator includes a heating chamber for containing water supplied from the reservoir, the heater is being disposed in the heating chamber for turning water contained in the chamber into steam.

3. The humidifier as claimed in claim 2, wherein the passage is supported by the heating chamber, and a lower end of the passage is spaced apart from the heating chamber by the opening and the opening is an annular gap.

4. The humidifier as claimed in claim 2, wherein the heating chamber has an upper wall with a plurality of nozzles through which the steam produced in the chamber may enter into the passage, the nozzles having a converging cross-section for increasing speed of flow of the steam passing through the nozzles.

5. The humidifier as claimed in claim 4, wherein the nozzles are arranged to point at a skewed direction relative to a central axis of the passage for causing swirling of the steam in the passage.

6. The humidifier as claimed in claim 2, wherein the heating chamber has an upper wall with a plurality of apertures through which the steam produced in the chamber may enter the passage, the heating chamber including an internal sleeve dividing the heating chamber into an inner chamber containing the apertures and the heater and an outer chamber surrounding the inner chamber, the outer chamber initially receiving water supplied from the reservoir and communicating with the inner chamber at a lower position.

7. The humidifier as claimed in claim 6, wherein the sleeve extends downwards from the upper wall around the apertures but not reaching a bottom of the heating chamber.

8. The humidifier as claimed in claim 2, wherein the heating chamber has a bottom opening, and including an inwardly extending pocket for receiving the heater and closing the bottom opening, thereby covering the heater while the heater heats water in the chamber.

9. The humidifier as claimed in claim 8, wherein the heater incorporates a heating element received in the pocket, and the pocket has a shape matching that of the heating element for contacting the heating element for efficient heat conduction.

10. The humidifier as claimed in claim 8, wherein the heating chamber is removable from the heater and the humidifier for cleaning.

11. The humidifier as claimed in claim 1, wherein the passage is a cylinder open at opposite ends.

* * * * *

UNITED STATES PATENT AND TRADEMARK OFFICE

CERTIFICATE OF CORRECTION

PATENT NO. : 6,226,451 B1
DATED : May 1, 2001
INVENTOR(S) : John Ying Man Wong

It is certified that error appears in the above-identified patent and that said Letters Patent is hereby corrected as shown below:

Title page,
Item [73], should read as follows:
-- [73] Raymond Electric (China) Ltd., New Territories (HK) --

Signed and Sealed this

Ninth Day of July, 2002

*Attest:*

*Attesting Officer*

JAMES E. ROGAN
*Director of the United States Patent and Trademark Office*